US009683535B2

(12) United States Patent
Glugla et al.

(10) Patent No.: US 9,683,535 B2
(45) Date of Patent: Jun. 20, 2017

(54) METHOD AND SYSTEM FOR DETECTION OF HOT SPARK PLUG FOULING

(71) Applicant: Ford Global Technologies, LLC, Dearborn, MI (US)

(72) Inventors: Chris Paul Glugla, Macomb, MI (US); Garlan J. Huberts, Milford, MI (US); Nelson William Morrow, Saline, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 64 days.

(21) Appl. No.: 14/755,980

(22) Filed: Jun. 30, 2015

(65) Prior Publication Data

US 2017/0002786 A1 Jan. 5, 2017

(51) Int. Cl.

| | |
|---|---|
| ***F02P 17/12*** | (2006.01) |
| ***F02P 11/06*** | (2006.01) |
| ***F02P 11/02*** | (2006.01) |

(52) U.S. Cl.

CPC ..... *F02P 17/12* (2013.01); *F02P 11/02* (2013.01); *F02P 11/06* (2013.01)

(58) Field of Classification Search

CPC ..... F02P 17/12; F02P 11/02; F02P 11/06

See application file for complete search history.

(56) References Cited

U.S. PATENT DOCUMENTS

| | | | | |
|---|---|---|---|---|
| 7,255,080 | B1 | 8/2007 | Leone | |
| 7,578,281 | B2 | 8/2009 | Russell et al. | |
| 8,997,723 | B2 | 4/2015 | Glugla et al. | |
| 9,043,122 | B2 | 5/2015 | Glugla et al. | |
| 2006/0016180 | A1* | 1/2006 | Tomita | F01N 3/0253 60/297 |
| 2007/0215130 | A1* | 9/2007 | Shelby | F02D 19/084 123/637 |
| 2009/0064663 | A1* | 3/2009 | Ma | F02D 41/1446 60/277 |
| 2011/0172897 | A1* | 7/2011 | Tsuzuki | F02D 35/023 701/103 |
| 2013/0139786 | A1* | 6/2013 | Glugla | F02D 41/0087 123/321 |
| 2014/0000557 | A1 | 1/2014 | Glugla et al. | |
| 2015/0112573 | A1 | 4/2015 | Huberts et al. | |
| 2015/0167573 | A1 | 6/2015 | Glugla et al. | |
| 2015/0176508 | A1 | 6/2015 | Glugla et al. | |
| 2015/0176558 | A1 | 6/2015 | Glugla et al. | |

* cited by examiner

*Primary Examiner* — Hieu T Vo
*Assistant Examiner* — Arnold Castro
(74) *Attorney, Agent, or Firm* — Julia Voutyras; McCoy Russell LLP

(57) ABSTRACT

Methods and systems are provided for inferring spark plug fouling due to accumulation of fuel additives thereon. In one example, an engine controller may infer spark plug hot fouling based on higher than expected exhaust temperatures by correlating the elevated exhaust temperature with late combustion phasing due to additive accumulation. A confidence factor of the spark plug hot fouling detection may be enhanced based on data regarding concurrent misfire and/or pre-ignition events.

18 Claims, 6 Drawing Sheets

METHOD AND SYSTEM FOR DETECTION OF HOT SPARK PLUG FOULING

FIELD

The present disclosure relates to methods and systems for detecting and addressing spark plug fouling due to the presence of fuel additives in an internal combustion engine.

BACKGROUND/SUMMARY

Engine ignition systems may include a spark plug for delivering an electric current to a combustion chamber of a spark-ignited engine to ignite an air-fuel mixture and initiate combustion. Based on engine operating conditions, spark plug fouling can occur wherein a firing tip of the spark plug insulator becomes coated with a foreign substance, such as fuel, oil, or soot. Once fouled, the spark plug may be unable to provide adequate voltage to trigger cylinder combustion until the spark plug is sufficiently cleaned or changed.

In areas with poor fuel quality control, spark plug fouling caused by hot spark plugs is a significant issue. Fuel additives such as methylcyclopentadienyl manganese tricarbonyl (MMT) are added to fuel in some countries to raise the octane level. However, the manganese in the fuel additive can coat the spark plug by building up electrically conductive and thermally insulating deposits on the spark plug ceramic. Such build up may cause pre-ignition (PI), and consequently engine damage. The build-up can also cause misfires. The spark plugs can also hot foul leading to rim firing. The rim firing can in turn lead to late burns, where fuel is not fully combusted in the combustion chamber, and burns into the exhaust manifold. The late burn contributes to the presence of increased residuals in adjacent cylinders, further increasing the likelihood of misfire and pre-ignition events. The manganese from the MMT can also coat exhaust oxygen sensors and contaminate precious metal bricks inside an exhaust catalytic converter. This results in eventual degradation of exhaust catalyst efficiency and the need for frequent catalyst replacement. Further, the accumulation of fuel additive may not be easily removed.

In one example, the above issues can be addressed by a method for inferring spark plug fouling due to accumulation of fuel additives thereon. The early detection enables appropriate mitigating steps to be taken in a timely manner, thereby pre-empting engine degradation. One example method comprises inferring spark plug fouling due to accumulation of fuel additive based on actual exhaust temperature being higher than estimated exhaust temperature, the estimated exhaust temperature based on engine operating conditions including air-fuel ratio, spark timing, and EGR. In this way, elevated exhaust temperatures can be better correlated with late combustion via MMT fouling of spark plugs.

As an example, an exhaust temperature may be modeled based on engine operating conditions. Therein, a flange temperature may be estimated based on engine speed and load, and further modified as a function of spark retard from MBT, air-fuel ratio, and EGR schedule. The estimated temperature may compensate for late combustion timing due to spark retard. An actual exhaust temperature may also be measured by an exhaust temperature sensor. If combustion occurs later than predicted due to fuel additive accumulation (e.g., during rim firing), the actual exhaust temperature may be significantly higher than the expected temperature (e.g., greater by more than a threshold amount). Thus, in response to the actual exhaust temperature being higher than the expected temperature, potential spark plug hot fouling due to fuel additive accumulation may be indicated. If there is a concurrent increase in an engine misfire rate or an engine pre-ignition rate, spark plug hot fouling may be confirmed with a higher confidence factor.

In this way, spark plug fouling due to fuel additives may be reliably identified. The technical effect of inferring spark plug hot fouling based on higher than expected exhaust temperatures is that excess exhaust heat from late combustion phasing may be more accurately attributed to the effect of MMT on a spark plug. By correlating the unexpected rise in exhaust temperature with a concurrent increase in the incidence of abnormal cylinder combustion events (such as pre-ignition, misfire, or knock) spark plug fouling due to fuel additive accumulation may be more reliably distinguished from spark plug fouling due to soot accumulation, or due to late combustion timing. In addition, exhaust over-temperature conditions can be monitored and addressed in a timely manner. The approach allows spark plug hot fouling to be accurately deduced without needing to rely only on complex and costly approaches (e.g., switching current measurements). By providing spark plug replacement recommendations based on evidence of malfunction or degradation, rather than a predetermined period of time or amount of vehicle usage, spark plug change recommendations may not be provided too soon, lowering overall vehicle operational costs for the driver, while also reducing the risk of engine pre-ignition. By diagnosing spark plug health, engine life is extended.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

The following description relates to systems and methods for inferring spark plug fouling due to accumulation of fuel additives thereon. The spark plugs are included in an engine system, such as the engine system of FIG. 1. Spark plug fouling may be inferred based on a comparison of actual and estimated exhaust temperature. A controller may perform a control routine, such as the example routine of FIG. 2, to infer spark plug hot fouling in response to actual exhaust temperatures being higher than estimated based on engine operating conditions (such as air-fuel ratio, FIG. 5). The controller may also monitoring a plurality of parameters for other signs of spark plug fouling, to increase the confidence of the exhaust temperature-based spark plug fouling inference. For example, the engine controller may monitor changes in an adaptive knock term, engine pre-ignition rate, engine misfire rate, and engine exhaust oxygen sensor switching frequency (or other parameters indicating a rate of exhaust catalyst degradation or exhaust oxygen sensor degradation). The controller may perform distinct mitigating actions based on whether spark plug fouling is due to accumulation of fuel additives or due to soot (FIGS. 3A-3B). An example detection of spark plug hot fouling is shown with reference to FIG. 4. In this way, early detection of spark plug hot fouling enables appropriate mitigating steps to be taken, thereby reducing engine degradation.

Figure 1:
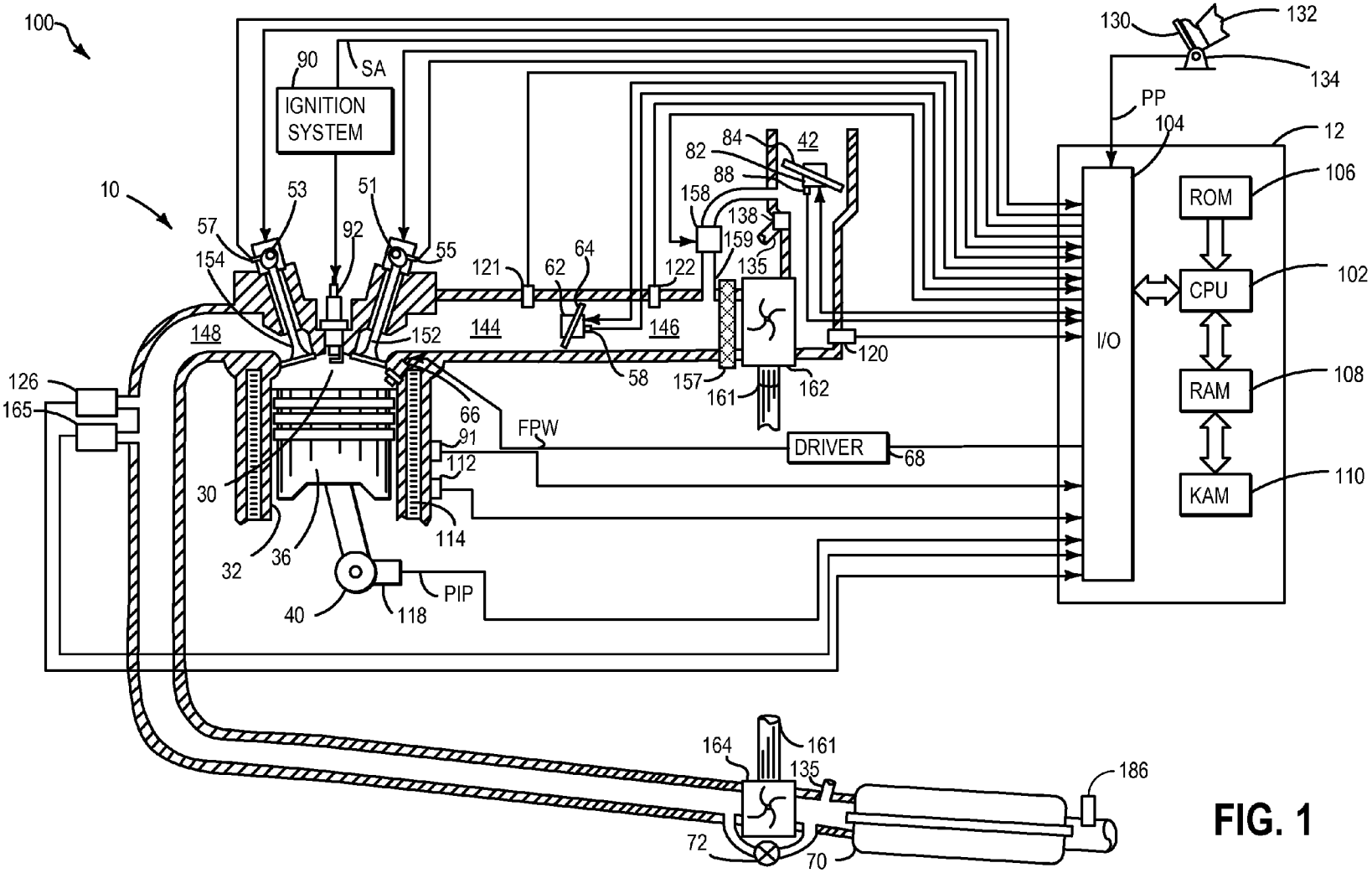
FIG. 1 is a schematic diagram of an engine.

FIG. 1 depicts an engine system 100 for a vehicle. The vehicle may be an on-road vehicle having drive wheels which contact a road surface. Engine system 100 includes engine 10 which comprises a plurality of cylinders. FIG. 1 describes one such cylinder or combustion chamber in detail. The various components of engine 10 may be controlled by electronic engine controller 12. Engine 10 includes combustion chamber 30 and cylinder walls 32 with piston 36 positioned therein and connected to crankshaft 40. Combustion chamber 30 is shown communicating with intake manifold 144 and exhaust manifold 148 via respective intake valve 152 and exhaust valve 154. Each intake and exhaust valve may be operated by an intake cam 51 and an exhaust cam 53. Alternatively, one or more of the intake and exhaust valves may be operated by an electromechanically controlled valve coil and armature assembly. The position of intake cam 51 may be determined by intake cam sensor 55. The position of exhaust cam 53 may be determined by exhaust cam sensor 57.

Fuel injector 66 is shown positioned to inject fuel directly into cylinder 30, which is known to those skilled in the art as direct injection. Alternatively, fuel may be injected to an intake port, which is known to those skilled in the art as port injection. Fuel injector 66 delivers liquid fuel in proportion to the pulse width of signal FPW from controller 12. Fuel is delivered to fuel injector 66 by a fuel system (not shown) including a fuel tank, fuel pump, and fuel rail. Fuel injector 66 is supplied operating current from driver 68 which responds to controller 12. In addition, intake manifold 144 is shown communicating with optional electronic throttle 62 which adjusts a position of throttle plate 64 to control airflow to engine cylinder 30. This may include controlling airflow of boosted air from intake boost chamber 146. In some embodiments, throttle 62 may be omitted and airflow to the engine may be controlled via a single air intake system throttle (AIS throttle) 82 coupled to air intake passage 42 and located upstream of the boost chamber 146.

In some embodiments, engine 10 is configured to provide exhaust gas recirculation, or EGR. When included, EGR is provided via EGR passage 135 and EGR valve 138 to the engine air intake system at a position downstream of air intake system (AIS) throttle 82 from a location in the exhaust system downstream of turbine 164. EGR may be drawn from the exhaust system to the intake air system when there is a pressure differential to drive the flow. A pressure differential can be created by partially closing AIS throttle 82. Throttle plate 84 controls pressure at the inlet to compressor 162. The AIS may be electrically controlled and its position may be adjusted based on optional position sensor 88.

Compressor 162 draws air from air intake passage 42 to supply boost chamber 146. In some examples, air intake passage 42 may include an air box (not shown) with a filter. Exhaust gases spin turbine 164 which is coupled to compressor 162 via shaft 161. A vacuum operated wastegate actuator 72 allows exhaust gases to bypass turbine 164 so that boost pressure can be controlled under varying operating conditions. In alternate embodiments, the wastegate actuator may be pressure or electrically actuated. Wastegate 72 may be closed (or an opening of the wastegate may be decreased) in response to increased boost demand, such as during an operator pedal tip-in. By closing the wastegate, exhaust pressures upstream of the turbine can be increased, raising turbine speed and peak power output. This allows boost pressure to be raised. Additionally, the wastegate can be moved toward the closed position to maintain desired boost pressure when the compressor recirculation valve is partially open. In another example, wastegate 72 may be opened (or an opening of the wastegate may be increased) in response to decreased boost demand, such as during an operator pedal tip-out. By opening the wastegate, exhaust pressures can be reduced, reducing turbine speed and turbine power. This allows boost pressure to be lowered.

Compressor recirculation valve 158 (CRV) may be provided in a compressor recirculation path 159 around compressor 162 so that air may move from the compressor outlet to the compressor inlet so as to reduce a pressure that may develop across compressor 162. A charge air cooler 157 may be positioned in passage 146, downstream of compressor 162, for cooling the boosted aircharge delivered to the engine intake. In the depicted example, compressor recirculation path 159 is configured to recirculate cooled compressed air from downstream of charge air cooler 157 to the compressor inlet. In alternate examples, compressor recirculation path 159 may be configured to recirculate compressed air from downstream of the compressor and upstream of charge air cooler 157 to the compressor inlet. CRV 158 may be opened and closed via an electric signal from controller 12. CRV 158 may be configured as a three-state valve having a default semi-open position from which it can be moved to a fully-open position or a fully-closed position.

Distributorless ignition system 90 provides an ignition spark to combustion chamber 30 via spark plug 92 in response to controller 12. The ignition system 90 may include an induction coil ignition system, in which an ignition coil transformer is connected to each spark plug of the engine. As such, the firing tip of the spark plug can become coated with a foreign substance, leading to spark plug fouling. For example, the spark plug may become coated with soot, resulting in spark plug soot fouling. As another example, the spark plug may become coated with residue from fuel additives, such as MMT, resulting in spark plug hot fouling. Once fouled, the spark plug may be unable to provide adequate voltage to trigger cylinder combustion, resulting in misfire events, and even abnormal combustion events such as knock or pre-ignition. Based on the nature of accumulation, the spark plug may need to be cleaned (e.g., in the case of soot accumulation) or changed (e.g., in the case of MMT accumulation) so as to restore spark plug function.

A first exhaust oxygen sensor 126 is shown coupled to exhaust manifold 148 upstream of catalytic converter 70. A second exhaust oxygen sensor 186 is shown coupled in the exhaust downstream of the converter 70. The first exhaust oxygen sensor 126 and the second exhaust oxygen sensor 186 may be any one of a Universal Exhaust Gas Oxygen (UEGO) sensor, a heated exhaust oxygen sensor (HEGO), or two-state exhaust oxygen sensor (EGO). The UEGO may be a linear sensor wherein the output is a linear pumping current proportional to an air-fuel ratio.

Additionally, an exhaust temperature sensor 165 is shown coupled to exhaust manifold 148 upstream of turbine 164. Output from the exhaust temperature sensor 165 may be used to learn an actual exhaust temperature. In addition, engine controller 12 may be configured to model a predicted exhaust temperature. For example, at a given engine speed and load, a flange temperature may be estimated. The results may then be used to populate a table of base temperatures. These temperatures may then be modified as a function of spark retard from MBT spark timing, air-fuel ratio, and EGR rate. The model may compensate for controlled late combustion, for example when it is controlled via known changes to a spark discharge location and timing, as commanded by the engine controller. However, if combustion occurs later than expected due to other factors (rim firing for example), then actual measured temperature indicated by exhaust temperature sensor 165 may be higher than the predicted temperature. Actual temperature, as measured by exhaust temperature sensor 165, being greater than a threshold above predicted temperature can be used to infer late combustion as a result of spark plug fouling due to the presence of fuel additives such as MMT (herein also referred to as hot fouling), as described further below with reference to FIG. 2. Other factors, for example a change in adaptive knock term, pre-ignition events, delayed oxygen sensor switch rate, or exhaust catalyst degradation rate over a vehicle drive cycle, may additionally be used to increase confidence that the elevated exhaust temperature is the result of MMT hot fouling.

Converter 70 includes an exhaust catalyst. For example, the converter 70 can include multiple catalyst bricks. In another example, multiple emission control devices, each with multiple bricks, can be used. Converter 70 can be a three-way type catalyst in one example. While the depicted example shows first exhaust oxygen sensor 126 upstream of turbine 164, it will be appreciated that in alternate embodiments, the first exhaust oxygen sensor 126 may be positioned in the exhaust manifold downstream of turbine 164 and upstream of convertor 70. Further, the first exhaust oxygen sensor 126 may be referred to herein as the pre-catalyst oxygen sensor and the second exhaust oxygen sensor 186 may be referred to herein as the post-catalyst oxygen sensor.

The first and second oxygen sensors may give an indication of exhaust air-fuel ratio. For example, the second exhaust oxygen sensor 186 may be used for catalyst monitoring while the first exhaust oxygen sensor 126 may be used for engine control. Further, both the first exhaust oxygen sensor 126 and the second exhaust oxygen sensor 186 may operate at a switching frequency or response time in which the sensor switches between lean and rich air-fuel control (e.g., switches from lean to rich or from rich to lean). In one example, an exhaust oxygen sensor degradation rate may be based on the switching frequency of the sensor, the degradation rate increasing for decreasing switching frequency. In another example, the exhaust oxygen sensor degradation rate may be based on a response time of the exhaust oxygen sensor, the degradation rate increasing for decreasing response time. For example, if the sensor is a linear sensor (such as a UEGO), the sensor degradation rate may be based on the response time of the sensor. Alternatively, if the sensor is not a linear sensor (such as a HEGO), the sensor degradation rate may based on the switching frequency of the sensor. For the purposes of describing the methods below, switching frequency and response time may be used interchangeably in inferring spark plug fouling. However, in some embodiments, the analysis of switching frequency vs. response time may be based on whether the exhaust oxygen sensor is nonlinear or linear, respectively.

Engine 10 may further include one (as depicted) or more knock sensors 91 distributed along a body of the engine (e.g., along an engine block). When included, the plurality of knock sensors may be distributed symmetrically or asymmetrically along the engine block. Knock sensor 91 may be an accelerometer (e.g., vibration sensor), an ionization sensor, or an in-cylinder transducer. In one example, the controller 12 may be configured to detect and differentiate engine block vibrations generated due to abnormal combustion events, such as knocking and pre-ignition with the knock sensor 91. For example, abnormal combustion of higher than threshold intensity detected in an earlier crank angle window, before a spark event, may be identified as pre-ignition while abnormal combustion of higher than threshold intensity detected in a later crank angle window, after a spark event, may be identified as knock. In addition, the intensity thresholds may be different, the threshold for pre-ignition being higher than the threshold for knock. Mitigating actions responsive to knock and pre-ignition may also differ, with knock being addressed with spark retard while pre-ignition is addressed with cylinder enrichment or enleanment.

Further, the controller 12 may be configured to perform adaptive knock control. Specifically, the controller 12 may apply a certain amount of spark angle retard to the ignition timing in response to sensing knock with the knock sensor 91. The amount of spark retard at the current speed-load operating point may be determined based on values stored in a speed/load characteristic map. This may be referred to as the adaptive knock term. When the engine is operating in the same speed-load region again, the adaptive knock term at the speed-load operation point may be updated. In this way, the adaptive knock term may be updated during engine operation. The adaptive knock term may be monitored over a predetermined duration (e.g., time or number of engine cycles) of engine operation or predetermined distance of vehicle travel. If knocking rates increase with an increasing change in the adaptive knock term, spark plug fouling may be indicated. As such, the controller may monitor knock via the knock sensor 91, as well as changes in the adaptive knock term in order to infer spark plug fouling, as described further below with reference to FIG. 2.

Controller 12 is shown in FIG. 1 as a microcomputer including: microprocessor unit 102, input/output ports 104, read-only memory 106, random access memory 108, keep alive memory 110, and a conventional data bus. Controller 12 is shown receiving various signals from sensors coupled to engine 10, in addition to those signals previously discussed, including: engine coolant temperature (ECT) from temperature sensor 112 coupled to cooling sleeve 114; a position sensor 134 coupled to an accelerator pedal 130 for sensing accelerator pedal position (PP) adjusted by a foot 132 of a vehicle operator; a knock sensor for determining ignition of end gases; a measurement of engine manifold pressure (MAP) from pressure sensor 121 coupled to intake manifold 144; a measurement of boost pressure from pressure sensor 122 coupled to boost chamber 146; an engine position sensor from a Hall effect sensor 118 (or other variable reluctance sensor) sensing crankshaft 40 position; a measurement of air mass entering the engine from sensor 120 (e.g., a hot wire air flow meter); and a measurement of throttle position from sensor 58. Barometric pressure may also be sensed (sensor not shown) for processing by controller 12. In a preferred aspect of the present description, engine position sensor 118 produces a predetermined number of equally spaced pulses every revolution of the crankshaft from which engine speed (RPM) can be determined. Controller 12 receives signals from the various sensors of FIG. 1 and employs the various actuators of FIG. 1 to adjust engine operation based on the received signals and instructions stored on a memory of the controller.

In some embodiments, the engine may be coupled to an electric motor/battery system in a hybrid vehicle. The hybrid vehicle may have a parallel configuration, series configuration, or variation or combinations thereof.

During operation, each cylinder within engine 10 typically undergoes a four stroke cycle: the cycle includes the intake stroke, compression stroke, expansion stroke, and exhaust stroke. During the intake stroke, generally, the exhaust valve 154 closes and intake valve 152 opens. Air is introduced into combustion chamber 30 via intake manifold 144, and piston 36 moves to the bottom of the cylinder so as to increase the volume within combustion chamber 30. The position at which piston 36 is near the bottom of the cylinder and at the end of its stroke (e.g., when combustion chamber 30 is at its largest volume) is typically referred to by those of skill in the art as bottom dead center (BDC). During the compression stroke, intake valve 152 and exhaust valve 154 are closed. Piston 36 moves toward the cylinder head so as to compress the air within combustion chamber 30. The point at which piston 36 is at the end of its stroke and closest to the cylinder head (e.g., when combustion chamber 30 is at its smallest volume) is typically referred to by those of skill in the art as top dead center (TDC). In a process hereinafter referred to as injection, fuel is introduced into the combustion chamber. In a process hereinafter referred to as ignition, the injected fuel is ignited by known ignition means such as spark plug 92, resulting in combustion. During the expansion stroke, the expanding gases push piston 36 back to BDC. Crankshaft 40 converts piston movement into a rotational torque of the rotary shaft. Finally, during the exhaust stroke, the exhaust valve 154 opens to release the combusted air-fuel mixture to exhaust manifold 148 and the piston returns to TDC. Note that the above is described merely as an example, and that intake and exhaust valve opening and/or closing timings may vary, such as to provide positive or negative valve overlap, late intake valve closing, or various other examples.

Figure 2:
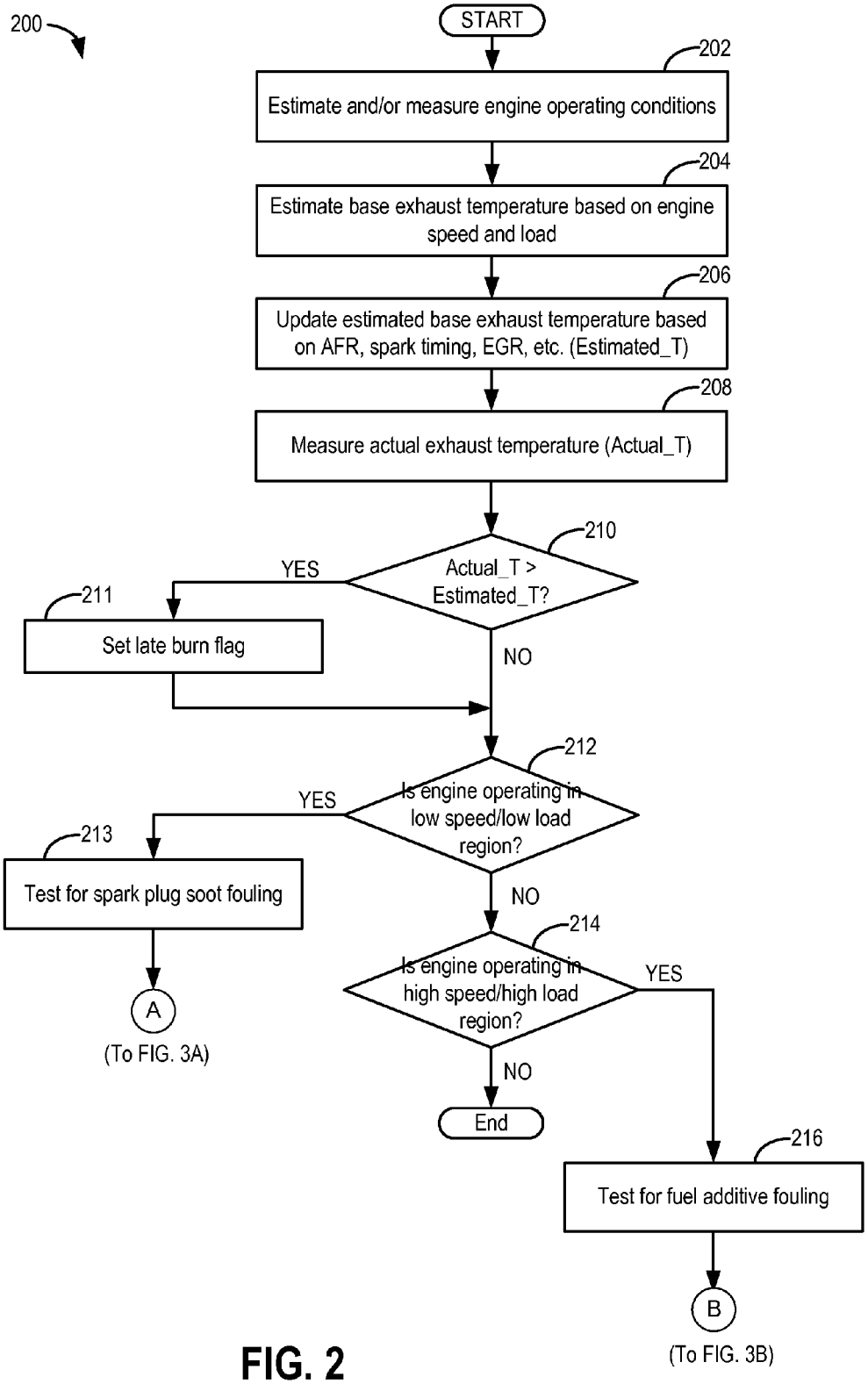
FIG. 2 shows a flow diagram of a method for inferring spark plug fouling from fuel additive based on a comparison of actual exhaust temperature and exhaust temperature estimated based on engine operating parameters.
Figure 3A:
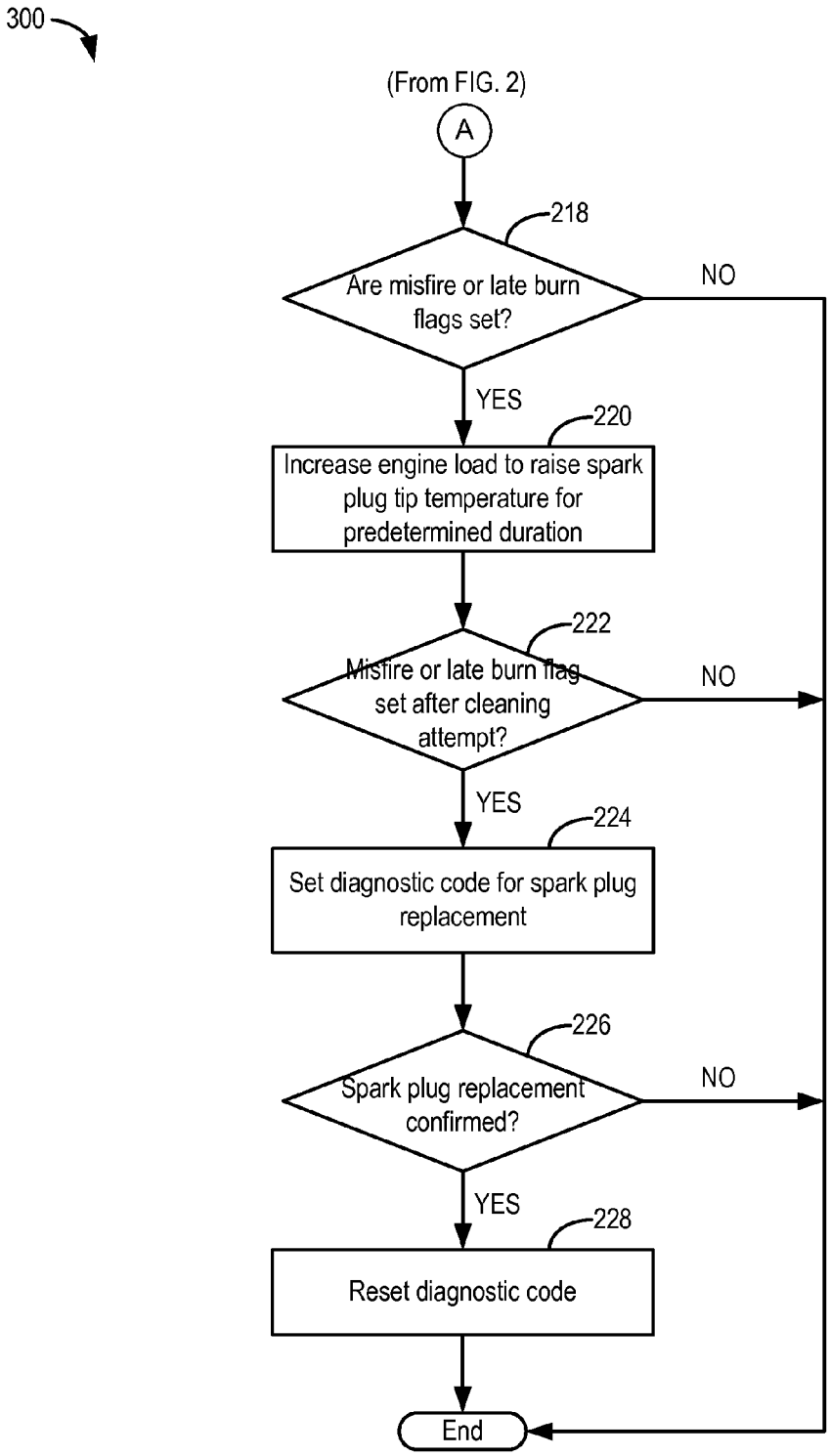
FIGS. 3A-3B show a method for distinguishing between spark plug hot fouling and soot fouling, and taking mitigating steps in accordance.
Figure 3B:
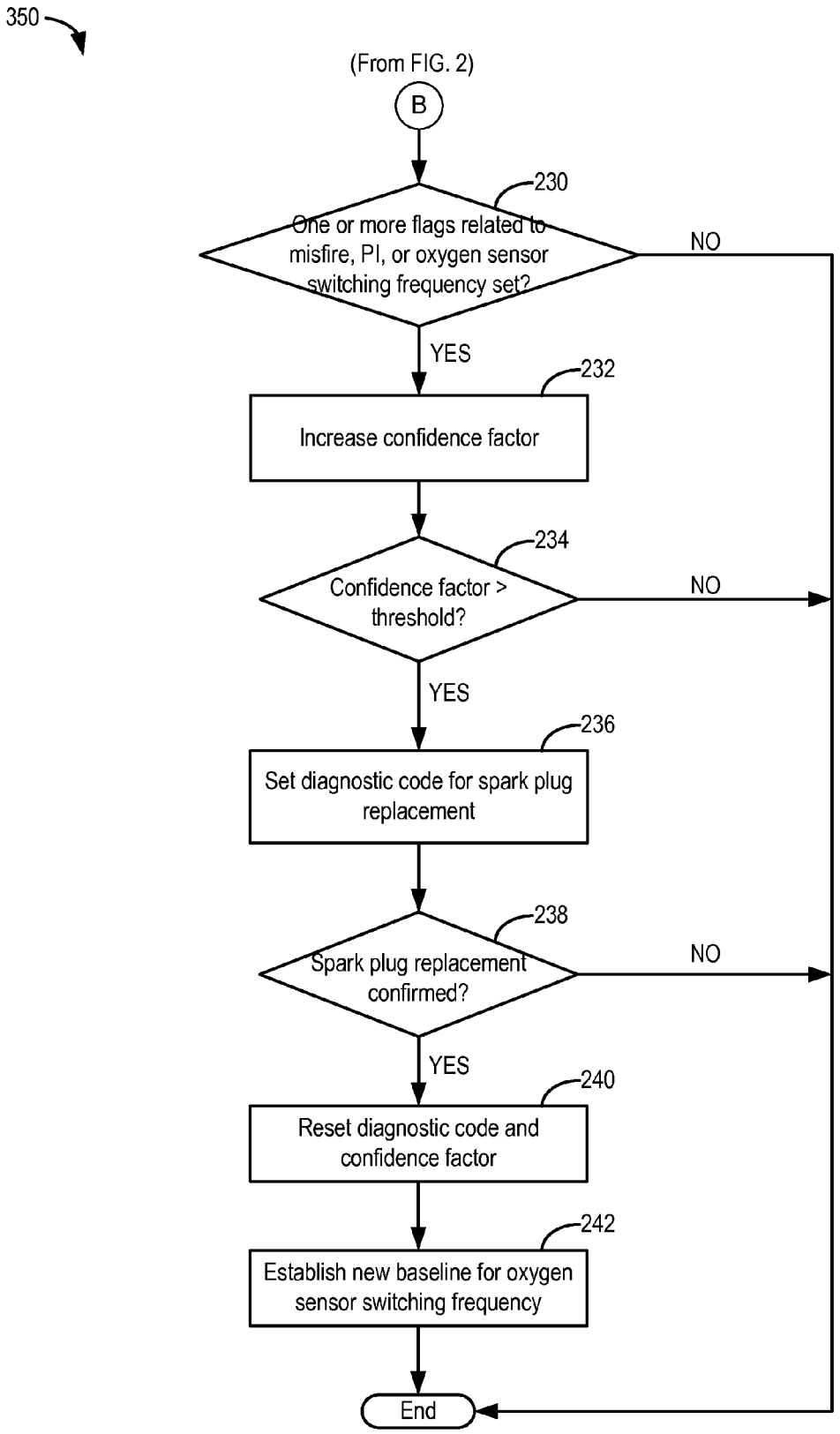

An example method 200 for indicating spark plug hot fouling is shown at FIG. 2. The method includes indicating spark plug fouling due to accumulation of fuel additive based on actual exhaust temperature being higher than estimated exhaust temperature. Specifically, the method determines late burn events based on a comparison of measured exhaust temperature to modeled exhaust temperature, and then further determines the potential cause of the late burns or misfires based on the engine operating region where the events occurred.

Instructions for carrying out method 200 and the rest of the methods included herein may be executed by a controller based on instructions stored on a memory of the controller and in conjunction with signals received from sensors of the engine system, such as the sensors described above with reference to FIG. 1. The controller may employ engine actuators of the engine system to adjust engine operation, according to the methods described below.

Method 200 begins at 202 by estimating and/or measuring engine operating conditions. Engine operating conditions estimated may include engine speed and load, mass air flow, pedal position, torque demand, boost, manifold pressure (MAP), manifold aircharge temperature (MCT), air-fuel ratio (lambda), fuel alcohol content, barometric pressure, ambient conditions (e.g., ambient temperature, pressure, humidity, etc.), engine pre-ignition history, crankshaft acceleration, knock rate, exhaust oxygen sensor switching frequency, etc.

Figure 5:
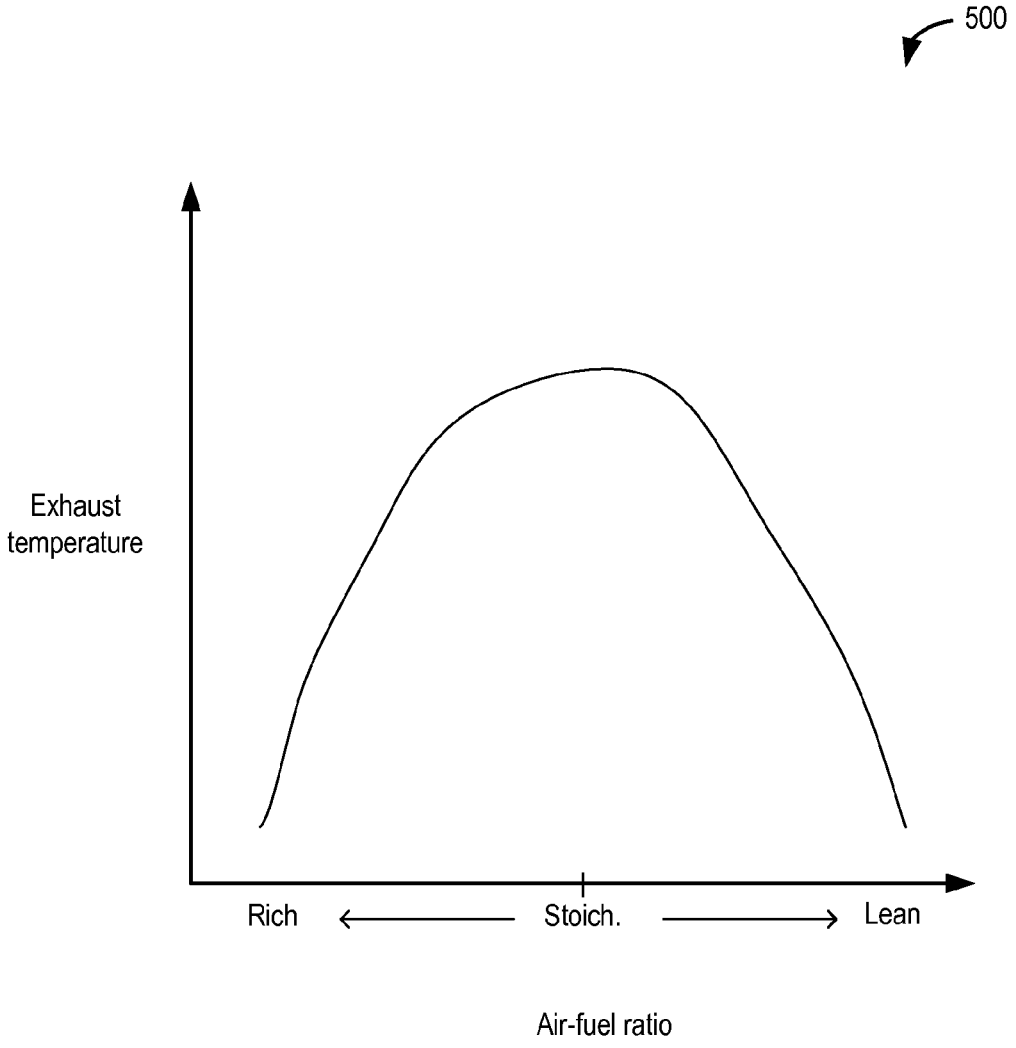
FIG. 5 shows an example relationship between exhaust temperature and combustion air-fuel ratio.

At 204, the method includes estimating a base exhaust temperature based on engine speed and load. The base exhaust temperature may be, for example, a flange temperature that is retrieved from a look-up table in the controller's memory. The flange temperature may be stored in the look-up table as a function of engine speed and load. As the engine speed or load increases, the base exhaust temperature may also increase. At 206, the estimated base exhaust temperature is updated based on one or more engine operating conditions including air-fuel ratio (lambda), spark timing, and EGR. For example, as spark retard is increased, the base exhaust temperature may be increased. As another example, as the amount of EGR increases, the exhaust temperature may be decreased. As still another example, as the exhaust air-fuel ratio is increased (thereby making the combustion mixture leaner than stoichiometry), the exhaust temperature may be decreased. Map 500 of FIG. 5 shows an example relationship between exhaust temperature and combustion air-fuel ratio. As shown therein, exhaust temperature is hottest near stoichiometry, the temperature decreasing as the air-fuel ratio becomes richer. On the lean side, the exhaust temperature rises at slightly leaner than stoichiometry, and then starts to becomes cooler. A rate of increasing the exhaust temperature responsive to the spark retard adjustment, the EGR adjustment, and the exhaust air-fuel adjustment may vary. For example, the predicted exhaust temperature may be increased by a larger amount responsive to the spark timing adjustment or the exhaust air-fuel ratio adjustment as compared to the EGR adjustment.

At 208, the method includes measuring the actual exhaust temperature (actual_T). The actual temperature is based on output from a temperature sensor coupled to an exhaust manifold of the engine, upstream of an exhaust catalyst. The values for actual_T and estimated_T are compared at 210, and specifically, it is determined if the actual exhaust temperature is higher than the predicted or modeled exhaust temperature. If the value of actual_T is greater than the value of estimated_T, then at 211, it is determined that a late burn event has occurred, and accordingly a late burn flag is set. In addition, possible spark plug fouling may be indicated. Specifically, the higher than expected exhaust temperature may be attributed to late combustion phasing as an effect of spark plug fouling due to soot or additive accumulation. The flag may be a flag indicating possible spark plug fouling as inferred by the difference between the actual exhaust temperature relative to the estimated exhaust temperature. In some examples, the flag may also include an estimate of a possible level of spark plug fouling based on the ratio or difference of actual_T to estimated_T, and further based on a frequency of late burn events. For example, as the ratio of or difference between actual_T and estimated_T increases, and a frequency of late burn events increases, spark plug fouling may be indicated to be more severe. Upon setting the late burn flag, the method moves to 212.

If the value of actual_T is not greater than the value of estimated_T, or if the value of actual_T is not greater than the value of estimated_T by more than a threshold amount, the method proceeds to 212 where it is determined if the engine is operating in a low speed and/or low load region. For example, it may be determined if the engine is operating below about 1500-2000 rpm.

As such, soot contamination of spark plugs occurs at low spark plug temperatures (and therefore at low speed/load conditions). Therefore, if misfires or late burns are detected in this operating region, they may be attributed to spark plug soot fouling. Accordingly, if low speed/load operating conditions are confirmed at 212, then at 213, the method includes testing for spark plug soot fouling, as determined by the method detailed in FIG. 3A.

If the engine is not operating in a low speed and/or low load region, the method proceeds to 214 where it is determined if the engine is operating in a high speed and/or high load region. For example, it may be determined if the engine is operating above 3000 rpm. As such, fuel additive fouling of spark plugs occurs at high spark plug temperatures (and therefore at high speed/load conditions). Therefore, if misfires, late burns, or pre-ignition are detected in this operating region over a vehicle driving cycle, and/or an oxygen sensor switching frequency degradation is detected, they may be attributed to spark plug hot fouling. Accordingly, if high speed/load operating conditions are confirmed at 214, then at 216, the method includes testing for spark plug fuel additive fouling, as determined by the method detailed in FIG. 3B. Now turning to FIG. 3A, a method 300 is shown for indicating and addressing spark plug soot fouling. Method 300 may be performed as part of the method of FIG. 2 when the engine is operating at low speed and/or low load conditions.

At 218, it may be determined if any misfire or late burn flags have been set over a given vehicle drive cycle. A misfire flag may be set in response to detection of a cylinder misfire event. A misfire event may be detected based on one or more of crankshaft acceleration, exhaust air-fuel ratio, output of an exhaust gas oxygen sensor, and spark plug ionization (e.g., ionization current as determined by an ionization sensor coupled to the spark plug). If misfire is detected, fuel may be disabled to the affected cylinder. Optionally, fuel delivered to a cylinder adjacent to the affected cylinder may also be temporarily enriched for a number of combustion events. In addition, an engine misfire counter may be updated. For example, each time a misfire occurs, the controller may increment the misfire counter in order to track the number of misfire events over a duration, and as a result, determine the engine misfire rate over a duration. In one example the duration may be a predetermined duration of engine operation (e.g., number of engine cycles or period of time) or a predetermined distance of vehicle travel. If the misfire rate is higher than a threshold rate, a misfire flag may be set.

A late burn flag may be set in response to detection of a cylinder late burn event. A cylinder late burn event may be detected based on measured exhaust temperature being higher than modeled exhaust temperature. Late burn may also be inferred based on one or more of a cylinder's (intake and/or exhaust) valve timing, spark timing, spark plug ionization current, crankshaft acceleration, and cylinder pressure. For example, a late burn may be determined in response to a combustion timing of the cylinder being retarded from a threshold timing. This may include an intake and/or exhaust valve timing of combustion in the cylinder being retarded from a threshold valve timing and/or a spark timing of combustion in the cylinder being retarded from a threshold spark timing (e.g., from MBT).

If no misfire or late burn flags are set, the routine ends. If any misfire or late burn flags are set, the method proceeds to 220 wherein the controller may attempt to clean the spark plug by burning off the accumulated soot. Therein, the controller may send a control signal to increase an engine load in order to raise the spark plug tip temperature above a threshold temperature for a predetermined duration (e.g., a predetermined number of combustion cycles). In another example, the controller may advance spark timing in order to increase spark plug temperature. Further still, the engine may be operated for a threshold number of combustion cycles. In this way, the controller may attempt to actively clean the soot fouled spark plug by increasing the spark plug temperature or passively clean the spark plug by operating the engine for a number of combustion cycles so that the soot fouling may resolve itself over the course of engine operation.

At 222, after the attempt at spark plug cleaning, it may be determined if a misfire or late burn flag is reset. If not, the routine ends. If the misfire or late burn flag persists, at 224, a diagnostic trouble code is set for spark plug replacement. Therein, the operator or vehicle service technician is informed that the spark plug needs to be replaced. At 226, it may be confirmed if the spark plug has been replaced. For example, it may be determined if operator input has been received regarding replacement of the spark plug. If not, the routine ends. Else, if the spark plug has been replaced, at 228, the method includes resetting the diagnostic code to indicate that the spark plug is not soot fouled anymore. The method then ends and exits.

Now turning to FIG. 3B, a method 350 is shown for indicating and addressing spark plug hot fouling (due to accumulation of fuel additive). Method 350 may be performed as part of the method of FIG. 2 when the engine is operating at high speed and/or high load conditions.

At 230, the method includes determining whether one or more flags related to cylinder misfire events, pre-ignition events, late burn events, oxygen sensor switching frequency, adaptive knock control, or exhaust catalyst degradation, have been set over the given vehicle drive cycle. Specifically, spark plug fouling due to accumulation of fuel additive may be confirmed, or further based on one or more of an engine pre-ignition rate, an engine misfire rate, an exhaust oxygen sensor degradation rate, an exhaust oxygen sensor switching frequency, a change in an adaptive knock term, exhaust catalyst degradation rate, and delayed combustion timing over a vehicle drive cycle.

As one example, if knock is detected (flagged), the controller may adjust spark timing by increasing spark retard, the retard amount based on a stored engine speed-load condition at which the knock was detected. The controller may then update and track the changing adaptive knock term. For example, at each fuel tank fill-up, an adaptive knock term may be stored, and the rate of change in the adaptive knock term may be tracked over a series of refueling events. In an alternate embodiment, the adaptive knock term may be monitored over a series of combustion cycles, a duration of engine operation, and/or a distance of vehicle travel. If a rate of change of the adaptive knock term is higher than a threshold rate, a corresponding flag may be set.

As another example, a cylinder misfire event may be detected based on one or more of crankshaft acceleration, exhaust air-fuel ratio, output of an exhaust gas oxygen sensor, and spark plug ionization (e.g., ionization current as determined by an ionization sensor coupled to the spark plug). If misfire is detected, fuel may be disabled to the affected cylinder. Optionally, fuel delivered to a cylinder adjacent to the affected cylinder may also be temporarily enriched for a number of combustion events. In addition, an engine misfire counter may be updated. For example, each time a misfire occurs, the controller may increment the misfire counter in order to track the number of misfire events over a duration, and as a result, determine the engine misfire rate over a duration. In one example the duration may be a predetermined duration of engine operation (e.g., number of engine cycles or period of time) or a predetermined distance of vehicle travel. If the misfire rate is higher than a threshold rate, a misfire flag may be set.

As yet another example, pre-ignition may be identified based on the output of an engine knock sensor in a crank angle window before a cylinder spark event. In response to pre-ignition, the controller may enrich (or enlean) the affected cylinder. Optionally, fuel injection to one or more cylinders other than the affected cylinder may also be adjusted. The controller may increment an engine pre-ignition (PI) counter responsive to the indication of pre-ignition. The PI counter may keep track of a number of pre-ignition events (or pre-ignition rate) occurring in the engine over a duration or distance of vehicle travel. When the pre-ignition rate (or counter output) is higher than a threshold, a pre-ignition flag may be set.

As yet another example, a first switching frequency or response time of a first exhaust oxygen sensor positioned upstream of an exhaust catalyst (e.g., an upstream exhaust oxygen sensor such as exhaust oxygen sensor 126 shown in FIG. 1, referred to herein as the pre-catalyst oxygen sensor) and a second switching frequency or response time of a second exhaust oxygen sensor positioned downstream of the exhaust catalyst (e.g., a downstream exhaust oxygen sensor such as exhaust oxygen sensor 186 shown in FIG. 1, referred to herein as the post-catalyst oxygen sensor) may be estimated. In response to the switching frequency of either sensor being lower than a threshold rate, an oxygen sensor switching frequency degradation flag may be set.

As such, components in fuel additive (such as manganese from MMT) can coat the spark plug by building up electrically conductive and thermally insulating deposits on the spark plug ceramic. Such build-up can cause increased likelihood of pre-ignition (PI), misfires, and knock events directly, as well as indirectly by causing late burns. The manganese from the MMT can also coat exhaust oxygen sensors and contaminate precious metal bricks inside an exhaust catalytic converter, leading to exhaust catalyst degradation and increasing a switching frequency of exhaust oxygen sensors. If one or more flags related to abnormal combustion are set, the controller may increase a confidence factor of the indication of spark plug fouling due to fuel additive accumulation at 232. If no additional flags related to misfire, pre-ignition, knock, and switching frequency degradation have been set, an increase in confidence factor is not initiated and the method ends.

The determined confidence factor may be used for indicating spark plug fouling due to fuel additive. The confidence factor may be determined from a difference between the estimated exhaust temperature and the actual exhaust temperature, and may be further increased as the difference between the estimated exhaust temperature and the actual exhaust temperature increases. The confidence factor may be further adjusted based on one or more of the engine pre-ignition rate, the engine misfire rate, the exhaust oxygen sensor degradation rate, the exhaust oxygen sensor switching frequency, the change in adaptive knock term, and the exhaust catalyst degradation rate over the vehicle cycle. For example, the confidence factor may be increased responsive to an increase in the engine pre-ignition rate and/or the engine misfire rate over the vehicle drive cycle.

In one example, the controller may indicate potential spark plug fouling due to additive accumulation in response to the actual exhaust temperature being higher than the predicted temperature, and then confirm spark plug fouling due to additive accumulation in response to one or more flags related to pre-ignition, knock, misfire, and exhaust catalyst degradation being set. The confidence factor may be adjusted based on the number of flags that are set, the confidence factor increased as the number of flags that are set increases. For example, the confidence factor may be increased further when the each of pre-ignition and misfire flags are set as compared to when any one of a pre-ignition and misfire flag is set. By correlating the increased incidence of pre-ignition, knock, misfire, and/or exhaust catalyst degradation with the higher than expected exhaust temperature (and later than expected combustion phasing), spark plug hot fouling can be deduced with higher reliability.

In still other examples, the confidence factor may be adjusted based on estimated exhaust temperature relative to the actual exhaust temperature, a number of misfire events, and an engine speed at which the misfire event occurred. For example, as depicted at FIGS. 2 and 3A-3B, spark plug hot fouling due to additive accumulation may be inferred (and the confidence factor may be increased) when actual exhaust temperature is higher than estimated exhaust temperature, and when cylinder misfire events occur at higher engine speed-load conditions. In comparison, spark plug fouling due to soot accumulation may be inferred (and the confidence factor may be decreased) when cylinder misfire events occur at lower engine speed-load conditions At 236, it may be determined if the confidence factor is higher than a threshold. If not, the routine ends. If the confidence factor is higher than the threshold, at 236, the method includes indicating spark plug fouling due to additive accumulation and setting a diagnostic code requesting spark plug replacement. Therein, the operator or vehicle service technician is informed that the spark plug needs to be replaced. Indicating spark plug fouling due to accumulation of fuel additive further includes indicating that the spark plug fouling is not due to accumulation of soot. In addition to indicating spark plug fouling, an identity of the hot fouled spark plug may be indicated. The identity of the fouled spark plug may be based on engine firing order. For example, the cylinder firing immediately before the detection of higher than expected exhaust temperatures may be determined to be fouled. In some examples, in addition to setting the diagnostic code, responsive to the indication of spark plug hot fouling, the controller may decrease engine load and deactivate fuel to the cylinder(s) coupled to the fouled spark plug(s) while maintaining spark ignition timing for the affected cylinder for a threshold duration, the threshold duration including a threshold number of combustion cycles since indicating spark plug hot fouling. Limiting the engine load may include reducing an intake aircharge amount. The intake aircharge amount may be reduced by reducing an intake throttle opening or increasing EGR (for example, by increasing an opening of an EGR valve). For example, the controller may send a signal to an electromechanical actuator coupled to the intake throttle to move the throttle valve to a less open position. As another example, the controller may send a signal to an electromechanical actuator coupled to the EGR valve to move the EGR valve to a more open position. In addition, one or more mitigating steps may be performed responsive to the one or more flags related to pre-ignition, knock, misfire, and exhaust catalyst degradation being set. For example, responsive to a flag indicating a high rate of cylinder pre-ignition, an affected cylinder may be enriched (or enleaned) for a duration. As another example, in response to a high rate of cylinder misfire, fueling of an affected cylinder may be shut off. As still another example, in response to a high rate of cylinder knock, spark timing may be retarded.

At 238, it may be confirmed if the spark plug has been replaced. For example, it may be determined if operator input has been received regarding replacement of the spark plug. If not, the routine ends. Else, if the spark plug has been replaced, at 240, the method includes resetting the diagnostic code to indicate that the spark plug is not hot fouled anymore. In addition, the confidence factor is reset. At 242, the method further includes establishing a new baseline for the oxygen sensor switching frequency. Further, in response to the operator input, the controller may also reset a monitor configured to count each of the change in adaptive knock term, the engine pre-ignition rate, the engine misfire rate, the exhaust oxygen sensor degradation rate, the exhaust oxygen sensor switching frequency, the change in adaptive knock term, and the exhaust catalyst degradation rate over the vehicle drive cycle. Resetting of the monitor is further based on an age of the spark plug relative to an age of one or more other engine components, which may include an exhaust oxygen sensor. The method then ends and exits.

Figure 4:
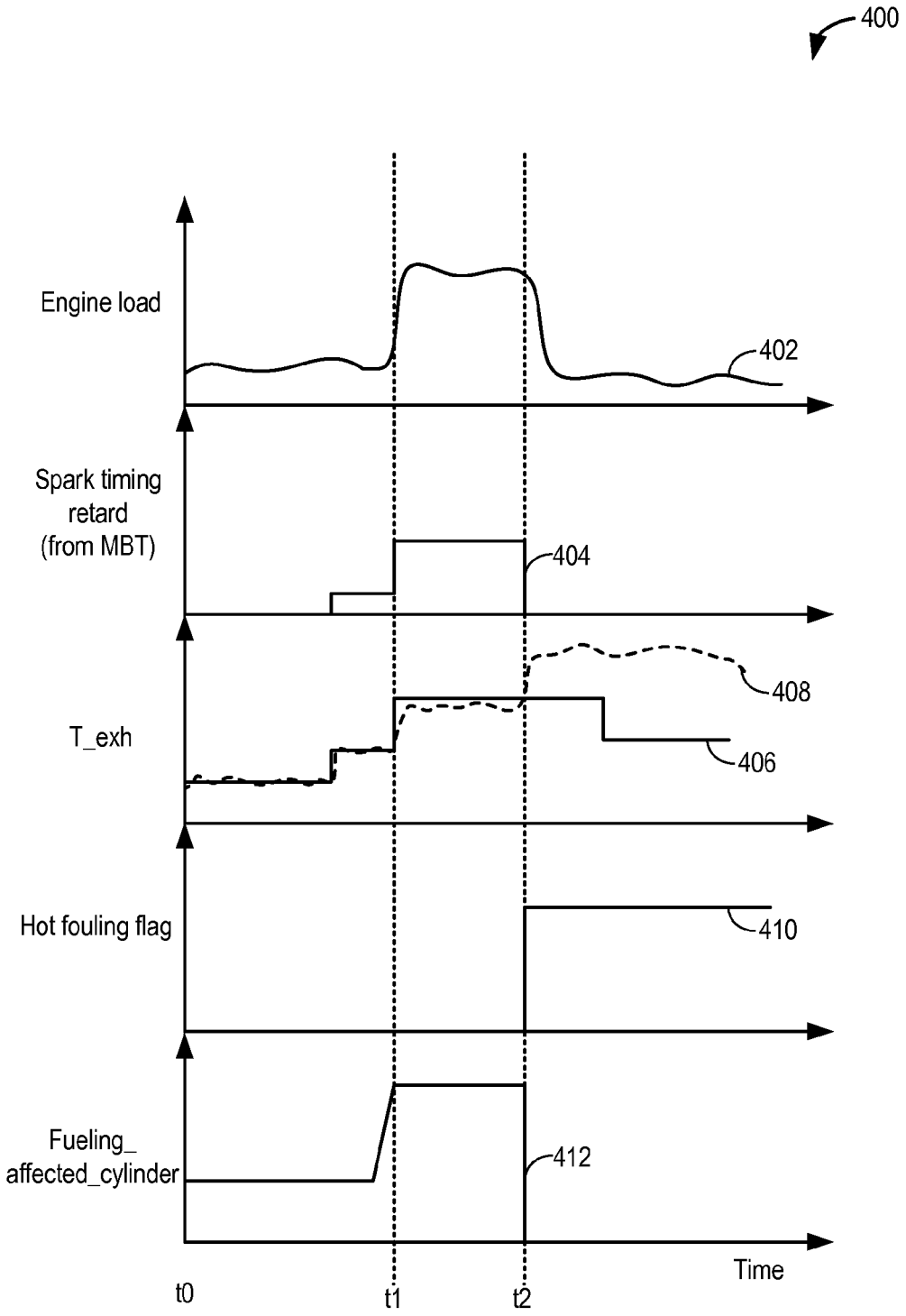
FIG. 4 shows an example exhaust spark plug hot fouling detection according to the present disclosure.

Turning now to FIG. 4, an example timeline 400 is shown for indicating and mitigating spark plug hot fouling due to fuel additive (MMT) using the methods described herein and with regards to FIGS. 2-3, and as applied to the engine system described herein and with regard to FIG. 1. Timeline 400 depicts engine load at plot 402, spark timing retard (from MBT) at plot 404, an estimated exhaust temperature at plot 406, a measured exhaust temperature at plot 408, a hot fouling flag at plot 410, and fueling of a specific cylinder at plot 412.

Between t0 and t1, the engine is operating at a low engine load (plot 402), substantially at steady-state conditions. Between t0 and t1, the estimated exhaust temperature is predicted based on the engine speed and load, and further based on spark timing. For example, the estimated exhaust temperature is increased when spark retard is increased. Also between t0 and t1, the estimated exhaust temperature (plot 406, solid line) correlates well the with the actual exhaust temperature measured by an exhaust temperature sensor (plot 408, dashed line).

At t1, in response to a tip-in event, or an increase in driver demanded torque, engine load may be increased. In addition, cylinder fueling is correspondingly increased (plot 412). Furthermore, spark timing retard (from MBT) is also increased. The estimated exhaust temperature accordingly rises, based on engine operating conditions including air-fuel ratio, spark timing, and EGR. The actual measured exhaust temperature also rises in correlation with the estimated exhaust temperature.

At t2, while engine load remains high, the actual measured exhaust temperature diverges substantially from the estimated exhaust temperature, with the actual exhaust temperature rising significantly above the estimated or predicted exhaust temperature. In response to the divergence, a hot fouling flag is set (plot 410). Herein, the spark fouling is indicated to be due to additive accumulation, and a diagnostic trouble code indicating the requirement for spark plug replacement is set. Fueling of the affected cylinder is discontinued, while maintaining fueling of remaining engine cylinders (not shown). Further, the remaining cylinders may be operated leaner than stoichiometry (e.g., at 1.05 lambda) to avert a catalyst exotherm. In addition, spark retard is reduced with spark timing returned to MBT or borderline, whichever is less advanced. In addition, an engine load is decreased.

It will be appreciated that while the above example identifies spark plug hot fouling based on actual exhaust temperature relative to estimated exhaust temperature only, in alternate examples, the hot fouling flag may be set in response to the concurrent occurrence of cylinder misfire, knock, or pre-ignition events.

In this way, in response to a first late combustion event at lower engine speed, where the exhaust temperature is above a threshold, a controller may indicate spark plug fouling due to soot accumulation. In comparison, in response to a second late combustion event at higher engine speed, where the exhaust temperature is above the threshold, the controller may indicate spark plug fouling due to fuel additive accumulation. In any or each of the above examples, the threshold may be based on engine operating conditions including each of combustion air-fuel ratio, EGR, and spark timing retard. In any of the preceding examples, the threshold may be increased as spark timing retard increases, combustion air-fuel ratio decreases, and/or EGR decreases. In any of the preceding examples, the second late combustion event may be accompanied by one or more of a misfire event and a pre-ignition event (such as both a misfire event and a pre-ignition event), while the first late combustion event is optionally accompanied by (only) a misfire event (and not a pre-ignition event). In any of the preceding examples, additionally or alternatively, in response to the first late combustion event, the controller may set a first diagnostic code and increase an engine load to raise a spark plug tip temperature to attempt spark plug cleaning, while in response to the second late combustion event, the controller may set a second, different diagnostic code and decrease the engine load to reduce the likelihood of engine pre-ignition events.

In another example, an engine system is provided comprising an engine including a cylinder, an ignition system including a spark plug coupled to the cylinder, a temperature sensor configured to measure an exhaust temperature, and a controller with computer readable instructions stored on non-transitory memory. The controller may be configured with code to indicate spark plug hot fouling in response to estimated exhaust temperature being higher than measured exhaust temperature while, concurrently, an engine pre-ignition rate or an engine misfire rate increases by more than a threshold amount over a drive cycle. In the above example, the estimated exhaust temperature may be based on one or more or each of an engine speed-load, an EGR rate, a spark ignition timing, and a combustion air-fuel ratio. In a further example, the controller may additionally or alternatively include instructions for indicating spark plug hot fouling by setting a diagnostic code distinct from a diagnostic code set in response to spark plug soot fouling. In any of the preceding examples, the controller may additionally or alternatively include code for limiting an engine load by reducing an intake aircharge amount by reducing an intake throttle opening or increasing EGR. In any of the preceding examples, the controller may also be configured to maintain spark timing, while deactivating fueling of the cylinder coupled to the hot fouled spark plug for a threshold number of combustion events since indicating the spark plug hot fouling.

In a further representation, a method for an engine comprises: indicating spark plug fouling due to fuel additive accumulation in response to actual exhaust temperature being higher than estimated exhaust temperature while an engine pre-ignition rate is higher than a threshold, and indicating spark plug fouling due to soot accumulation in response to actual exhaust temperature being higher than estimated exhaust temperature while an engine pre-ignition rate is lower than a threshold.

In another further representation, a method for an engine comprises: indicating spark plug fouling due to fuel additive accumulation in response to a late burn event (wherein actual exhaust temperature being higher than estimated exhaust temperature) while an engine speed and/or load is higher than a threshold, and indicating spark plug fouling due to soot accumulation in response to a late burn event (where actual exhaust temperature is higher than estimated exhaust temperature) while an engine speed and/or load is lower than the threshold. The method further includes, indicating spark plug fouling due to soot accumulation responsive to a misfire event occurring in addition to the late burn event, and indicating spark plug fouling due to fuel additive accumulation responsive to a pre-ignition event occurring in addition to the late burn event.

In this way, spark plug hot fouling may be accurately deduced without needing to rely only on complex and costly approaches (e.g., switching current measurements). Further, by monitoring multiple parameters whose change may be associated with spark plug health, spark plug fouling due to fuel additive accumulation may be more reliably distinguished from spark plug fouling due to soot accumulation or late combustion timing, with greater confidence. As such, actions may be taken based on determined spark plug fouling to reduce and/or mitigate the effects of fouled spark plugs. Additionally, by recommending spark plug replacements based on evidence of malfunction or degradation, rather than a predetermined amount of vehicle operation or time period, vehicle operational costs may be lowered and engine life may be extended.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method for an engine, comprising:

indicating spark plug fouling due to accumulation of fuel additive based on an actual exhaust temperature being higher than estimated exhaust temperature, the estimated exhaust temperature based on engine operating conditions including air-fuel ratio, spark timing, and EGR, the indicating spark plug fouling due to accumulation of fuel additive including setting a diagnostic code, the diagnostic code requesting spark plug replacement, and wherein indicating spark plug fouling due to accumulation of fuel additive further includes indicating spark plug fouling not due to accumulation of soot.

2. The method of claim 1, wherein the indicating is further based on one or more of an engine pre-ignition rate, an engine misfire rate, an exhaust oxygen sensor degradation rate, an exhaust oxygen sensor switching frequency, a change in an adaptive knock term, and an exhaust catalyst degradation rate over a vehicle drive cycle.

3. The method of claim 2, wherein the indicating is based on a confidence factor that is determined from a difference between the estimated exhaust temperature and the actual exhaust temperature, the method further comprising adjusting the confidence factor based on one or more of the engine pre-ignition rate, the engine misfire rate, the exhaust oxygen sensor degradation rate, the exhaust oxygen sensor switching frequency, the change in adaptive knock term, and the exhaust catalyst degradation rate over the vehicle drive cycle.

4. The method of claim 3, wherein the confidence factor is increased as the difference between the estimated exhaust temperature and the actual exhaust temperature increases.

5. The method of claim 4, wherein the adjusting includes increasing the confidence factor responsive to an increase in the engine pre-ignition rate and/or the engine misfire rate over the vehicle drive cycle.

6. The method of claim 2, further comprising, receiving operator input regarding replacement of the spark plug, and in response to an operator input, resetting a monitor configured to count each of the engine pre-ignition rate, the engine misfire rate, the exhaust oxygen sensor degradation rate, the exhaust oxygen sensor switching frequency, the change in adaptive knock term, and the exhaust catalyst degradation rate over the vehicle drive cycle.

7. The method of claim 6, wherein the resetting is based on an age of the spark plug relative to an age of one or more other engine components including an exhaust oxygen sensor.

8. The method of claim 7, wherein the spark plug is coupled to a cylinder, the method further comprising, in response to the indication of spark plug fouling due to accumulation of fuel additive, decreasing an engine load and disabling fuel while maintaining spark ignition timing for the cylinder for a threshold duration, the threshold duration including a threshold number of combustion cycles.

9. The method of claim 1, wherein the indicating is further based on combustion timing being delayed.

10. The method of claim 1, wherein the actual exhaust temperature is based on output from a temperature sensor coupled to an exhaust manifold of the engine, upstream of an exhaust catalyst.

11. An engine system, comprising:

an engine including a cylinder;

an ignition system including a spark plug coupled to the cylinder;

a temperature sensor configured to measure an exhaust temperature; and a controller with computer readable instructions stored on non-transitory memory for:

indicating spark plug hot fouling in response to estimated exhaust temperature being higher than measured exhaust temperature while, concurrently, an engine pre-ignition rate or an engine misfire rate increases by more than a threshold amount over a drive cycle.

12. The system of claim 11, wherein the estimated exhaust temperature is based on each of an engine speed-load, an EGR rate, a spark plug timing, and a combustion air-fuel ratio.

13. The system of claim 11, wherein the controller includes further instructions for:

indicating spark plug hot fouling by setting a diagnostic code that is distinct from a diagnostic code set in response to spark plug soot fouling; and limiting an engine load by reducing an intake aircharge amount.

14. The system of claim 13, wherein the controller includes further instructions for: while maintaining spark timing, deactivating fueling of the cylinder coupled to the hot fouled spark plug for a threshold number of combustion events since the indicating.

15. A method for an engine, comprising:

in response to a first late combustion event at lower engine speed, where an exhaust temperature is above a threshold, indicating spark plug fouling due to soot accumulation, the threshold based on engine operating conditions including each of combustion air-fuel ratio, EGR, and spark timing retard; and in response to a second late combustion event at higher engine speed, where the exhaust temperature is above the threshold, indicating spark plug fouling due to fuel additive accumulation.

16. The method of claim 15, wherein the threshold is increased as spark timing retard increases, combustion air-fuel ratio decreases, and/or EGR decreases.

17. The method of claim 15, wherein the second late combustion event is accompanied by one or more of a misfire event and a pre-ignition event, and wherein the first late combustion event is optionally accompanied by only a misfire event.

18. The method of claim 15, further comprising, in response to the first late combustion event, setting a first diagnostic code and increasing an engine load; and in response to the second late combustion event, setting a second, different diagnostic code and decreasing an engine load.

* * * * *